US007059098B2

(12) United States Patent
Kim

(10) Patent No.: US 7,059,098 B2
(45) Date of Patent: Jun. 13, 2006

(54) AUTOMATIC MEDICATION DISPENSING AND PACKAGING SYSTEM

(76) Inventor: Jun Ho Kim, 100-23, Galsandong, Dalsuhgu, Taegu (KR)

( * ) Notice: Subject to any disclaimer, the term of this patent is extended or adjusted under 35 U.S.C. 154(b) by 129 days.

(21) Appl. No.: 10/846,202

(22) Filed: May 14, 2004

(65) Prior Publication Data

US 2004/0226855 A1 Nov. 18, 2004

(30) Foreign Application Priority Data

May 16, 2003 (KR) ..... 10-2003-0031283

(51) Int. Cl.
*B65B 61/26* (2006.01)
*B65B 35/54* (2006.01)
*B65H 1/00* (2006.01)

(52) U.S. Cl. ..... 53/131.4; 53/154; 53/168; 53/568; 53/237; 53/284.7; 221/133

(58) Field of Classification Search ..... 53/131.4, 53/131.5, 168, 568, 237, 247, 255, 154, 284.7, 53/374.4; 221/133; 312/42
See application file for complete search history.

(56) References Cited

U.S. PATENT DOCUMENTS

| | | | | |
|---|---|---|---|---|
| 5,709,063 | A * | 1/1998 | Yuyama et al. | 53/154 |
| 5,852,911 | A * | 12/1998 | Yuyama et al. | 53/168 |
| 5,930,145 | A * | 7/1999 | Yuyama et al. | 700/231 |
| 6,012,602 | A * | 1/2000 | Yuyama et al. | 221/133 |
| 6,145,700 | A * | 11/2000 | Takahashi et al. | 221/133 |
| 6,540,101 | B1 | 4/2003 | Kim | |
| 6,581,356 | B1 | 6/2003 | Kim | |
| 6,585,132 | B1 | 7/2003 | Kim | |
| 6,647,702 | B1 | 11/2003 | Kim | |
| 2003/0057225 | A1 * | 3/2003 | Kim | 221/92 |

* cited by examiner

*Primary Examiner*—Stephen F. Gerrity
(74) *Attorney, Agent, or Firm*—John K. Park; Park Law Firm

(57) ABSTRACT

An automatic medication dispensing and packaging system comprising a medication dispensing unit having base and door cabinets, the door cabinet rear portion correspondingly and detachably engaged to the base cabinet rear portion, the base cabinets distanced from each other to form a space that allows therein a manual management of the dispensing unit. The manual management includes cassette replacements, tablet filling in the cassettes, and spatial shaft cleaning.

18 Claims, 7 Drawing Sheets

AUTOMATIC MEDICATION DISPENSING AND PACKAGING SYSTEM

CLAIMING FOREIGN PRIORITY

The applicant claims and requests a foreign priority, through the Paris Convention for the Protection of Industry Property, based on a patent application filed in the Republic of Korea (South Korea) with the filing date of May 16, 2003, with the patent application number 10-2003-0031283, by the applicant. (See the attached Declaration)

BACKGROUND OF THE INVENTION

The invention relates to a pharmaceutical automation system. More particularly, the present invention relates to an automatic medication dispensing and packaging system realizing increase of tablet cassette capacity in a limited machine space while facilitating tablet debris or dust cleaning.

An automatic tablet dispensing and packaging system is generally provided with a tablet packaging portion and a tablet dropping portion placed above the packaging portion. The tablet dropping portion includes a plurality of tablet cassettes containing different sets of tablets. Korean Utility Model No. 2002-5029 discloses a plurality of sliding cabinets having tablet cassettes to slidably pull out the sliding cabinets for cassette replacements or tablet refill-in the cassettes to accommodate 300 or more tablet cassettes. Korean Patent Application No. 1986-2173 discloses tablet cassette array in a horizontal alignment in a shelf construction. Korean Patent Application No. 1990-12411 discloses polar array of tablet cassettes in a vertical alignment.

Such prior arts, however, each require an elongate hopper to guide the tablets released from the cassettes down to the packaging unit. It is disadvantageous since horizontally elongate hoppers hold the tablets released thereon for a longer period of time and thus result in delay of tablet packaging time in the packaging unit.

Further, the conventional cassette array requires a higher system side walls and causes the hopper to be raised, thereby deteriorating space efficiency. Especially, if the hopper is raised to meet the conventional cassette construction, the tablets have to roll or bounce in the hopper for a longer period of time thereby generating tablet debris and dust, which may lead to increase of danger factors because even a slight amount of the tablet debris if mixed with another prescription may cause a negative medical affect on patients. The conventional tablet cassette cabinets make it also difficult to cleaning and maintenance of the system parts and demands more time for cassette attachments and replacements.

SUMMARY OF THE INVENTION

The present invention is contrived to overcome the conventional disadvantages. Accordingly, it is an object of the present invention to provide an automatic medication dispensing and packaging system facilitating the cleaning of tablet debris with improved convenience. Another object is to improve machine space efficiency by enabling more tablets cassette accommodation in a limited machine space. A still further object is to decrease the time period for tablets to stay in a hopper so as to realize a high speed tablet packaging mechanism.

To achieve these and other objects, an automatic medication dispensing and packaging system comprises a medication dispensing unit having first, second base and door cabinets. The cabinets are each defined by a front portion and a rear portion, and the door cabinet rear portion is correspondingly, detachably engaged to the base cabinet rear portion. In this construction, the base cabinets are distanced from each other to form a space that allows therein a manual management of the dispensing unit. The manual management includes cassette replacements, tablet filling in the cassettes, and spatial shaft cleaning. For a better performance, a front portion of the rear cabinet is exposed to the space.

The medication dispensing unit is defined by a front surface, a rear surface and side surfaces. A front door is formed in the front surface to externally expose the space when required. The rear portion of said each cabinet is vertically wrinkled to form ridges and furrows so that when the door cabinets are attached to the base cabinet a plurality of spatial shafts are formed by the furrows and ridges of the cabinet rear portions. Here, tablet cassettes each containing tablets are installed in said each cabinet to selectively release the tablets through the spatial shafts. The spatial shafts serving as downward channels guide down the released tablets. The tablet cassettes are detachably racked in the cabinets in columns and rows.

Meanwhile, a hopper is provided beneath the dispensing unit to guide down the tablets released via the spatial shafts from the cassettes, and a medication packaging unit is disposed below the dispensing unit while housing therein the hopper. The tablets released via the hopper from the dispensing unit are packaged into a series of tablet containing paper bags.

Selectively, a rear cabinet is formed between the base cabinets to become perpendicular to at least one of the base and door cabinets. There may be further provided an engagement member to control the detachable attachment of the door cabinets to the base cabinets. The cabinets are each aligned rear to front, and a side door is formed in said each side surface to facilitate cassette filling and spatial shaft cleaning. The base cabinets are aligned substantially parallel to each other.

The medication packaging unit includes a printer to print respective information on a packaging paper, and a heater assembly to package the tablets released through the hopper into the paper bags using the packaging paper. The heating assembly includes heating rollers to consecutively seal the packaging paper to the tablet containing paper bags.

The advantages of the present invention are numerous in that: (1) the surrounding alignment of the tablet cabinets enables more tablet cassette accommodation while reserving the space within the system for a system operator to conveniently work on tablet cassettes and tablet debris, thereby improving product reliability; (2) the rear to front alignment of the cabinets having tablet cassettes maximizes the machine space efficiency by more than doubling the tablet cassette capacity compared to the conventional horizontal tablet cassette alignment, thereby maximizing satisfaction of the pharmacists and system operators; and (3) the lowered, streamlined hopper construction resulting from the rear to front alignment of the tablet cassette cabinets substantially decreases the time period for the released tablets to become packaged into a series of tablet containing paper bags in the packaging unit, thereby improving usability and marketability.

Although the present invention is briefly summarized, the full understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
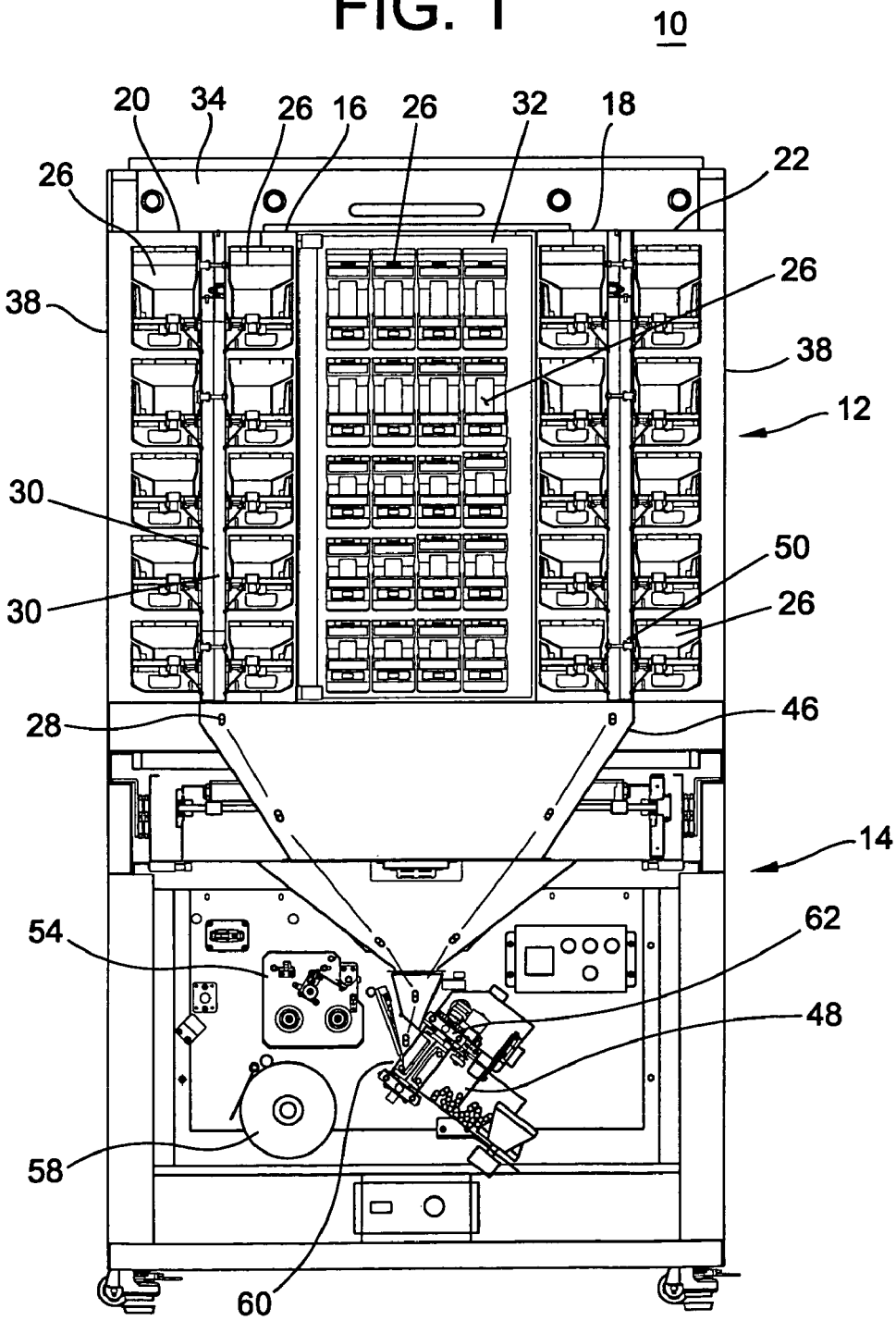
FIG. 1 is a front view of an automatic medication dispensing and packaging system according to the present invention.
Figure 2:
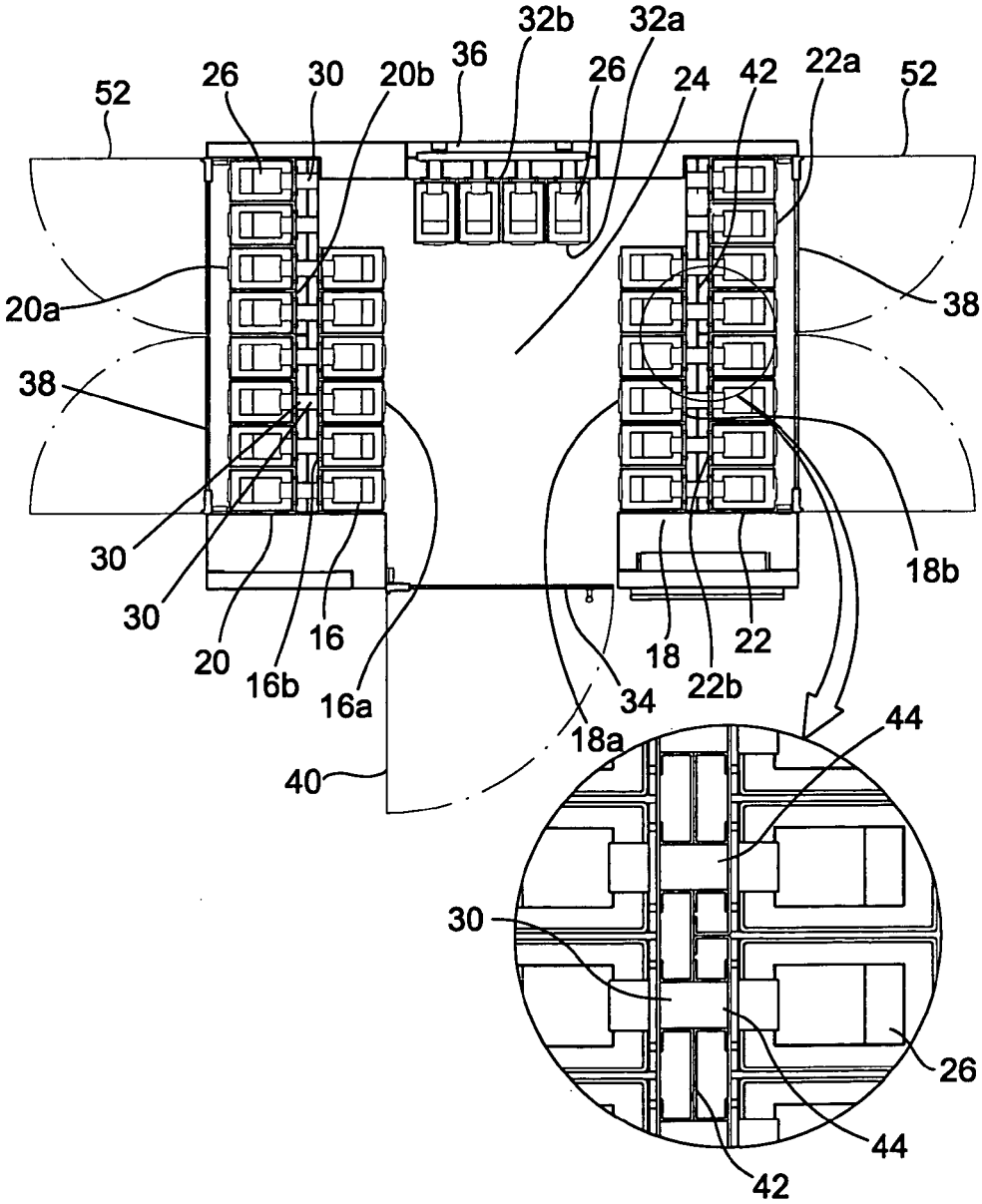
FIG. 2 is a cross-sectional top view of FIG. 1.

FIG. 1 shows an automatic medication dispensing and packaging system 10 according to the present invention, and FIG. 2 shows a schematic cross-sectional view of FIG. 1. As shown therein, the system 10 comprises a medication dispensing unit 12, a prescription tablet packaging unit 14.

The medication dispensing unit 12 has first and second base cabinets 16, 18, and first and second door cabinets 20, 22. The cabinets 16, 18, 20, 22 are each defined by a front portion 16*a*, 18*a*, 20*a*, 22*a* and a rear portion 16*b*, 18*b*, 20*b*, 22*b*. The door cabinet rear portion 20*b*, 22*b* is correspondingly, detachably engaged to the base cabinet rear portion 16*b*, 18*b*. The base cabinets 16, 18 are distanced from each other to form a space 24 that allows therein a manual management of the dispensing unit 12. The manual management includes cassette 26 replacements, tablet 28 filling in cassettes 26, and spatial shaft 30 cleaning.

In a preferred mode, a rear cabinet 32 is formed between the base cabinets 18, 20 to become perpendicular to at least one of the base and door cabinets 16, 18, 20, 22. In this construction, it is recommended that a front portion 32*a* of the rear cabinet 32 is exposed to the space 24.

The medication dispensing unit 12 is defined by a front surface 34, a rear surface 36 and side surfaces 38. Here, a front door 40 is preferably formed in the front surface 34 to externally expose the space 24 when required. That is, the front door 40 serves as an access point to the space 24 so that a system operation can access the space 24 for manual checkup required system management through the front door 40.

Figure 3:
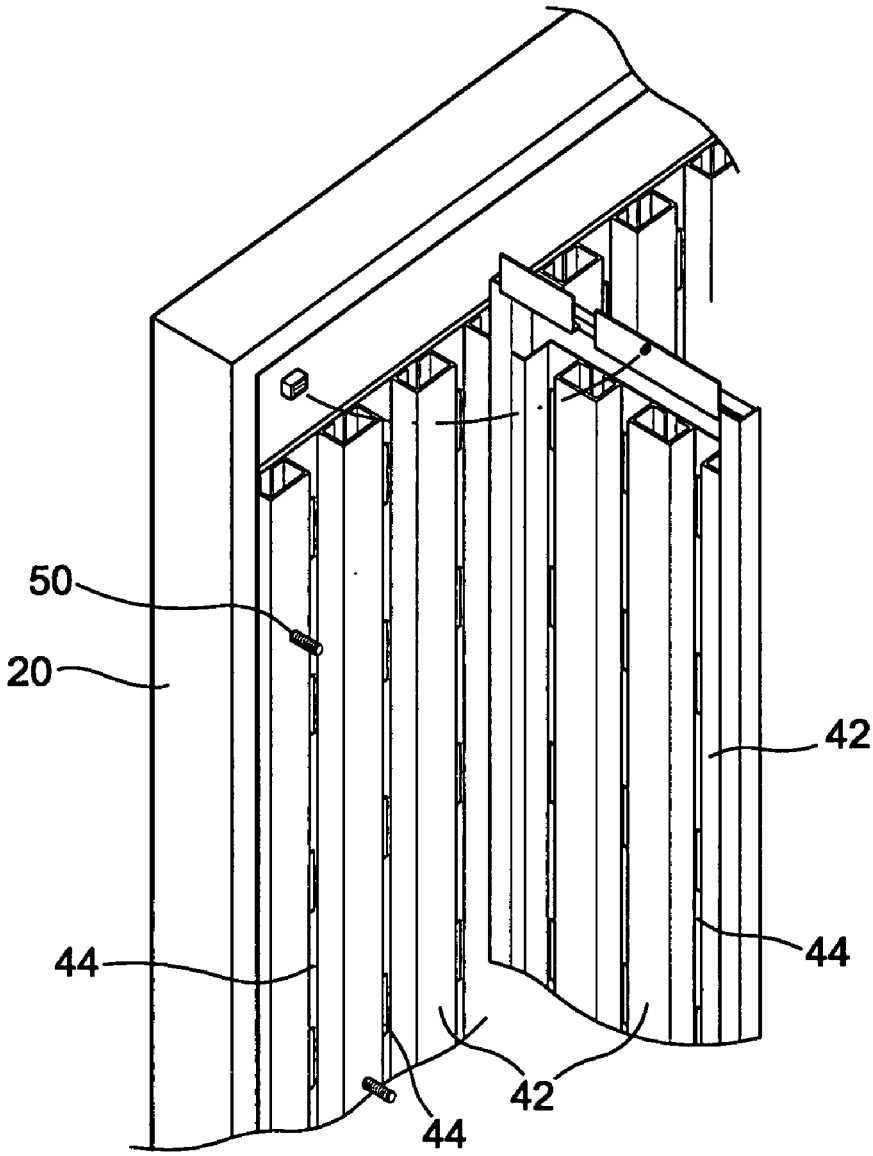
FIG. 3 is a view showing a spatial shaft mechanism according to the present invention.
Figure 4:
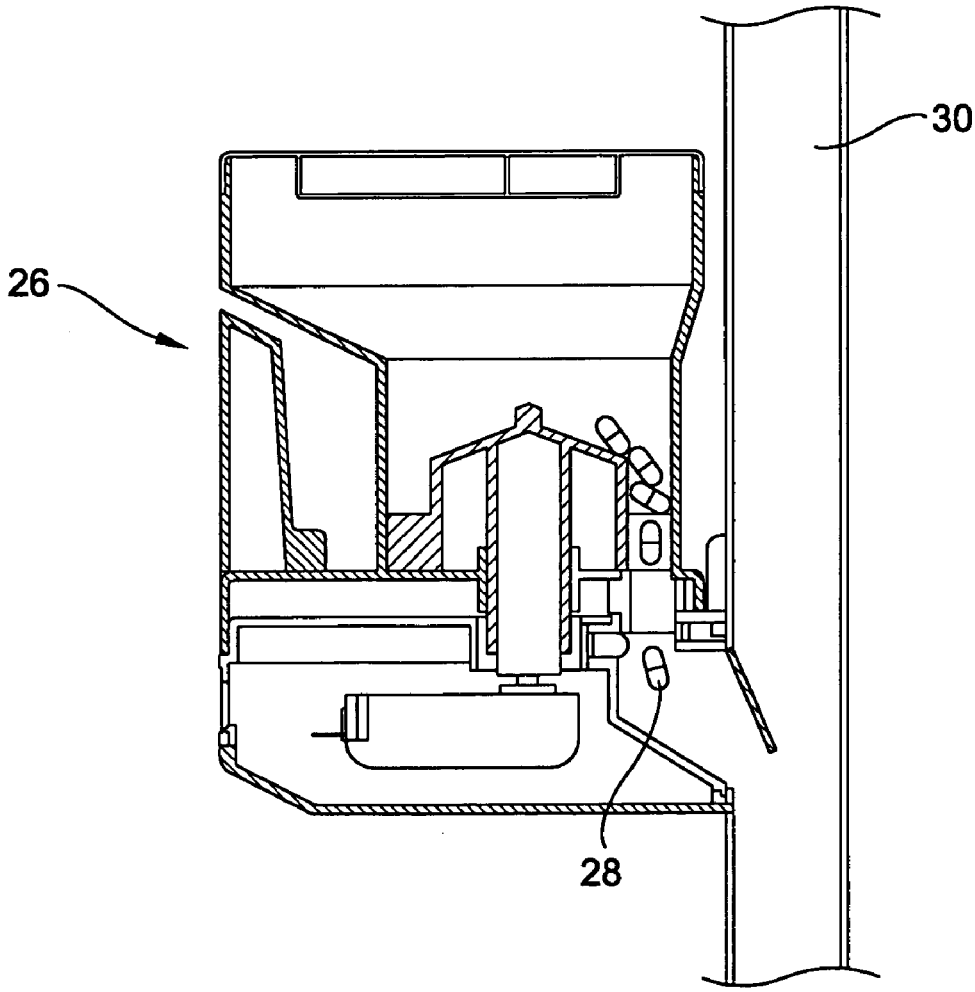
FIG. 4 is a view showing a tablet cassette mechanism according to the present invention.

With further reference to FIGS. 3 and 4, the rear portion 16*b*, 18*b*, 20*b*, 22*b* of each cabinet 16, 18, 20, 22 including the rear portion 32*b* of the rear cabinet 32 is vertically wrinkled to form ridges 42 and furrows 44 so that when the door cabinets 20,22 are attached to the base cabinets 16, 18 a plurality of spatial shafts 30 are formed by the furrows 44 and ridges 42 of the cabinet rear portions 16*b*, 18*b*, 20*b*, 22*b*. The tablet cassettes 26 each containing tablets 28 are installed in each cabinet 16, 18, 20, 22, 32 to selectively release the tablets 28 through the spatial shafts 30. The spatial shafts 30 serving as downward channels guide down the released tablets 28.

Figure 5:
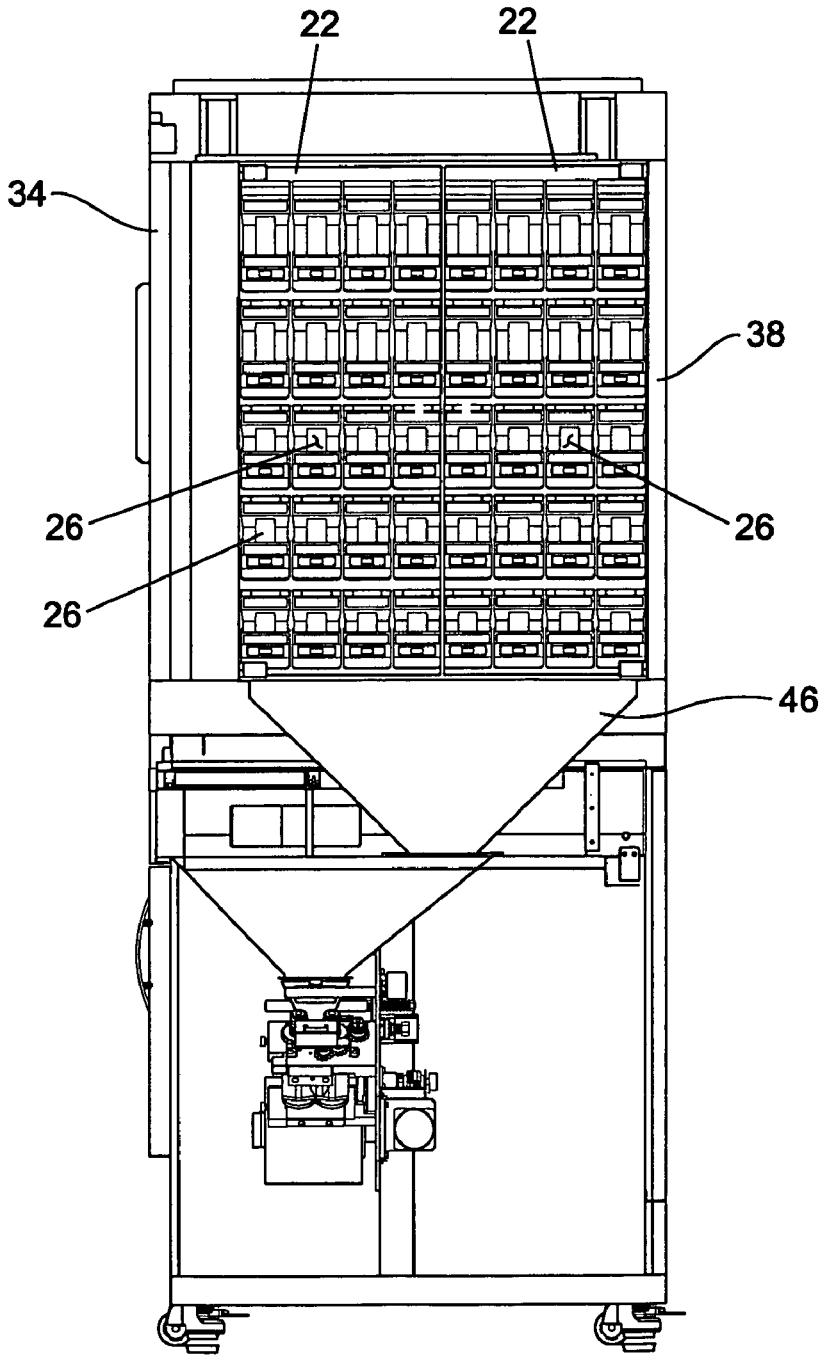
FIG. 5 is a side view showing a door cabinet according to the present invention.
Figure 6:
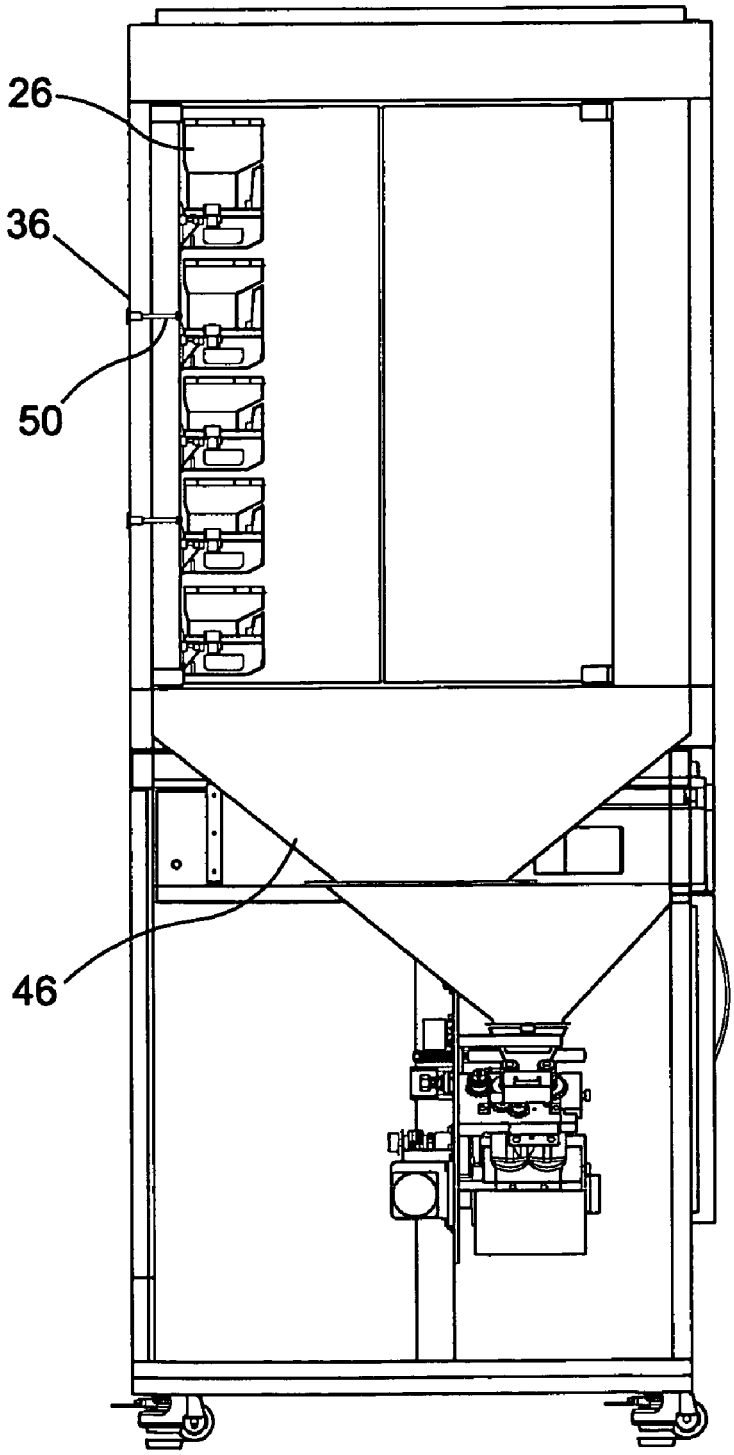
FIG. 6 is another side view showing a rear cabinet according to the present invention.
Figure 7:
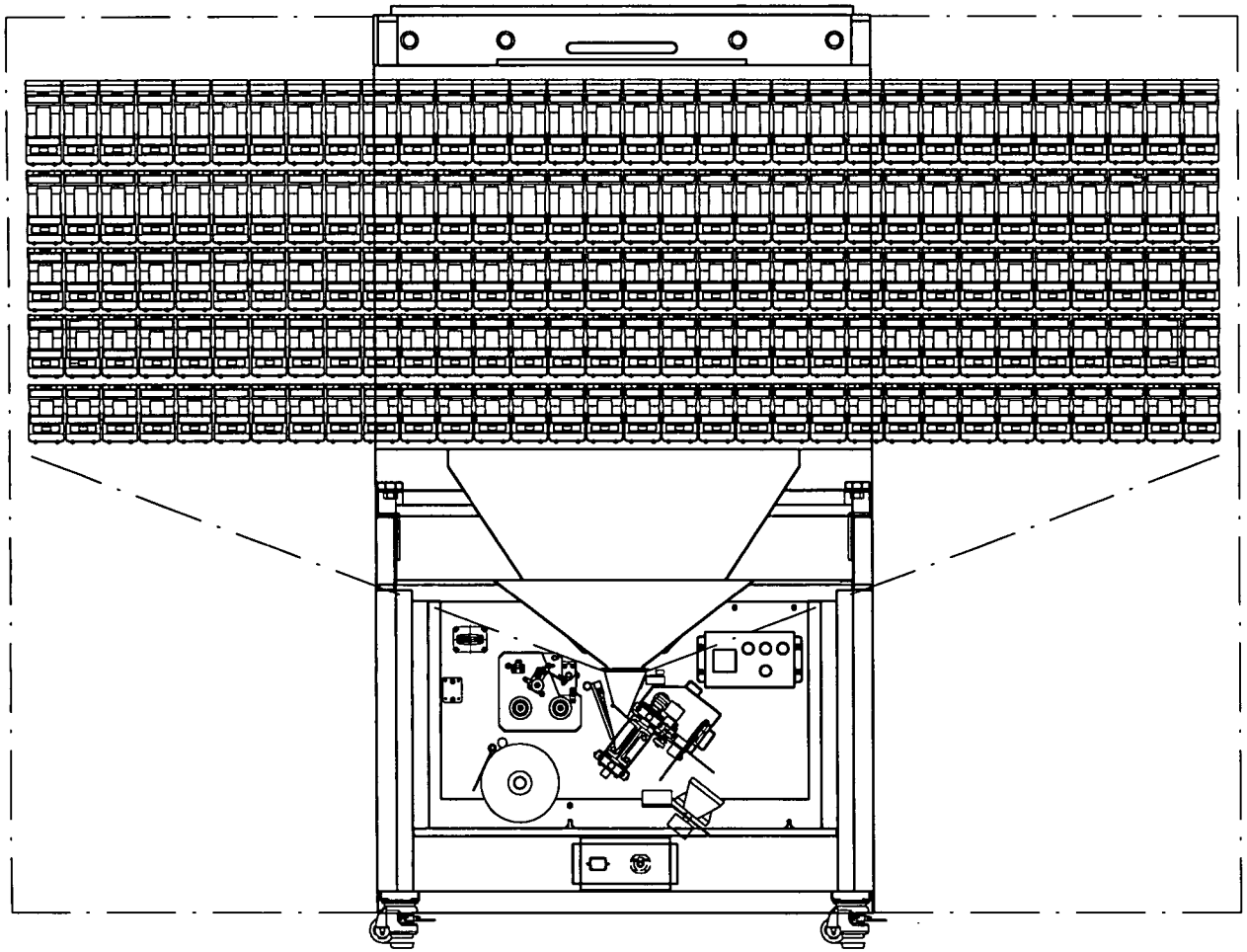
FIG. 7 is a view showing an imaginary side-to-side alignment of tablet cassettes to show an equivalent number of the tablet cassettes according to the present invention.

As further illustrated in FIGS. 5 and 6, the tablet cassettes 26 are detachably racked in the cabinets 16, 18, 20, 22, 32 in columns and rows. Meanwhile, FIG. 7 shows an imaginary side-to-side cassette alignment using an equivalent number of the tablet cassettes used in the present system 10. As shown therein, the number of cassettes stackable in the conventional side-to-side alignment would be limited to the width of the front surface 34 of the system 10. So the rear-to-front cassette alignment with the central space 24 reserves for manual system management is optimally realized in a compact to mid size pharmaceutical system enabling an automatic tablet dispensing and packaging that the system 10 of the present invention aims at.

In order to facilitate the tablet dispensing mechanism, a hopper 46 is provided beneath the dispensing unit 12 to guide down the tablets 28 released via the spatial shafts 30 from the cassettes 26. The medication packaging unit 14 is disposed below the dispensing unit 12 while housing therein the hopper 46. The tablets 28 released via the hopper 46 from the dispensing unit 12 are packaged into a series of tablet containing paper bags 48.

An engagement member 50 is provided to control the detachable attachment of the door cabinets 20, 22 to the base cabinets 16, 18. Here, it is preferred that the base and door cabinets, 16, 18, 20, 22 are each aligned rear to front. A side door 52 is formed in each side surface 38 to facilitate cassette filling and spatial shaft cleaning. The base cabinets 16, 18 may be selectively aligned substantially parallel to each other.

The medication packaging unit 14 comprises a printer 54 to print respective information on a packaging-paper 58, and a heater assembly 60 to package the tablets 28 released through the hopper 46 into the paper bags 48 using the packaging paper 58. The heating assembly 60 includes heating rollers 62 to consecutively seal the packaging paper 58 to the tablet containing paper bags 48.

As discussed above, an advantage of the present invention is that the surrounding alignment of the tablet cabinets 16, 18, 20, 22, 32 enables more tablet cassette accommodation while reserving the space 24 within the system 10 for a system operator to conveniently work on tablet cassettes 26 and tablet debris, thereby improving product-reliability. In addition, the rear to front alignment of the base and door cabinets 16, 18, 20, 22 having tablet cassettes 26 maximizes the machine space efficiency by more than doubling the tablet cassette capacity compared to the conventional horizontal tablet cassette alignment, thereby maximizing satisfaction of the pharmacists and system operators.

Further, the lowered, streamlined hopper construction resulting from the rear to front alignment of the tablet cassette cabinets 16, 18, 20, 22 substantially decreases the time period for the released tablets 28 to become packaged into a series of tablet containing paper bags 48 in the packaging unit 14, thereby improving usability and marketability.

As discussed above, an advantages of the present invention is that the surrounding alignment of the tablet cabinets enables more tablet cassette accommodation while reserving the space 24 within the system for a system operator to conveniently work on tablet cassettes and tablet debris, thereby improving product reliability. In addition, the rear to front alignment of the cabinets having tablet cassettes maximizes the machine space efficiency by more than doubling the tablet cassette capacity compared to the conventional side-to-side tablet cassette alignment, thereby maximizing satisfaction of the pharmacists and system operators Further, the lowered, streamlined hopper construction resulting from the rear to front alignment of the tablet cassette cabinets substantially decreases the time period for the released tablets 28 to become packaged into a series of tablet containing paper bags 48 in the packaging unit 14, thereby improving usability and marketability.

Although the invention has been described in considerable detail with reference to certain preferred versions thereof, other versions are possible by converting the aforementioned construction. Therefore, the scope of the invention shall not be limited by the specification specified above and the appended claims.

What is claimed is:

1. An automatic medication dispensing and packaging system, comprising:

a) a medication dispensing unit having first, second base and door cabinets, wherein the cabinets are each defined by a front portion and a rear portion, wherein the door cabinet rear portion is correspondingly, detachably engaged to the base cabinet rear portion, wherein the base cabinets are distanced from each other to form a space that allows therein a manual management of the dispensing unit, wherein the rear portion of said each cabinet is vertically wrinkled to form ridges and furrows so that when the door cabinets are attached to the base cabinet a plurality of spatial shafts are formed by the furrows and ridges of the cabinet rear portions, wherein tablet cassettes each containing tablets are installed in said each cabinet to selectively release the tablets through the spatial shafts, wherein the spatial shafts serving as downward channels guide down the released tablets;

b) a hopper beneath the dispensing unit to guide down the tablets released via the spatial shafts from the cassettes; and c) a medication packaging unit disposed below the dispensing unit while housing therein the hopper, wherein the tablets released via the hopper from the dispensing unit are packaged into a series of tablet containing paper bags.

2. The system of claim 1 wherein the medication dispensing unit is defined by a front surface, a rear surface and side surfaces, wherein a front door is formed in the front surface to externally expose the space when required.

3. The system of claim 2 wherein the cabinets are each aligned rear to front, wherein a side door is formed in said each side surface to facilitate cassette filling and spatial shaft cleaning.

4. The system of claim 1 wherein the base cabinets are aligned substantially parallel to each other.

5. The system of claim 1 wherein the tablet cassettes are detachably racked in the cabinets in columns and rows.

6. The system of claim 1 wherein the medication packaging unit comprises:

a) a printer to print respective information on a packaging paper; and b) a heater assembly to package the tablets released through the hopper into the paper bags using the packaging paper.

7. The system of claim 6 wherein the heating assembly includes heating rollers to consecutively seal the packaging paper to the tablet containing paper bags.

8. The system of claim 1 wherein the manual management includes cassette replacements, tablet filling in the cassettes, and spatial shaft cleaning.

9. An automatic medication dispensing and packaging system, comprising:

a) a medication dispensing unit having first, second base and door cabinets, wherein a rear cabinet is formed between the base cabinets to become perpendicular to at least one of the base and door cabinets, wherein the base and door cabinets are each defined by a front portion and a rear portion, wherein the door cabinet rear portion is correspondingly, detachably engaged to the base cabinet rear portion, wherein the base cabinets are distanced from each other to form a space that allows therein a manual management of the dispensing unit, wherein said each rear portion is vertically wrinkled to form ridges and furrows so that when the door cabinets are attached to the base cabinet a plurality of spatial shafts are formed by the furrows and ridges of the cabinet rear portions, wherein tablet cassettes each containing tablets are installed in said each cabinet to selectively release the tablets through the spatial shafts, wherein the spatial shafts serving as downward channels guide down the released tablets;

b) a hopper beneath the dispensing unit to guide down the tablets released via the spatial shafts from the cassettes; and c) a medication packaging unit disposed below the dispensing unit while housing therein the hopper, wherein the tablets released via the hopper from the dispensing unit are packaged into a series of tablet containing paper bags.

10. The system of claim 9 wherein the medication dispensing unit is defined by a front surface, a rear surface and side surfaces, wherein a front door is formed in the front surface to externally expose the space when required.

11. The system of claim 10 wherein the cabinets are each aligned rear to front, wherein a side door is formed in said each side surface to facilitate cassette filling and spatial shaft cleaning.

12. The system of claim 9 wherein the base cabinets are aligned substantially parallel to each other.

13. The system of claim 9 wherein the tablet cassettes are detachably racked in the cabinets in columns and rows.

14. The system of claim 9 wherein the medication packaging unit comprises:

a) a printer to print respective information on a packaging paper; and b) a heater assembly to package the tablets released through the hopper into the paper bags using the packaging paper.

15. The system of claim 14 wherein the heating assembly includes heating rollers to consecutively seal the packaging paper to the tablet containing paper bags.

16. The system of claim 9 wherein the manual management includes cassette replacements, tablet filling in the cassette, and spatial shaft cleaning.

17. The system of claim 9 wherein a front portion of the rear cabinet is exposed to the space.

18. The system of claim 9 further comprising an engagement member to control the detachable attachment of the door cabinets to the base cabinets.

* * * * *